US006441311B2

(12) United States Patent
Fukumoto et al.

(10) Patent No.: US 6,441,311 B2
(45) Date of Patent: Aug. 27, 2002

(54) POWER SUPPLY TERMINAL FOR USE WITH A MOTOR-DRIVEN COMPRESSOR AND METHOD OF INSULATING SAME

(75) Inventors: Minoru Fukumoto, Nara (JP); Nobuyuki Nishii, Otsu (JP); Makoto Yoshida, Kusatsu (JP)

(73) Assignees: Matsushita Electric Industrial Co., Ltd., Osaka (JP); Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/740,814

(22) Filed: Dec. 21, 2000

(30) Foreign Application Priority Data

Dec. 22, 1999 (JP) ..... 11-364418

(51) Int. Cl.[7] ..... H01B 17/00; H01R 13/52

(52) U.S. Cl. ..... 174/138 F; 174/DIG. 8; 174/152 GM; 439/523; 439/932; 439/935

(58) Field of Search ..... 174/DIG. 8, 137 R, 174/138 F, 151, 152 R, 152 GM; 439/523, 932, 935; 361/22

(56) References Cited

U.S. PATENT DOCUMENTS 3,551,191 A * 12/1970 Elbling et al. ..... 174/152 GM
3,721,948 A * 3/1973 Brandt et al. ..... 174/152 GM
4,252,394 A * 2/1981 Miller ..... 174/152 GM
4,431,469 A * 2/1984 Falcomato ..... 174/DIG. 8
4,461,925 A * 7/1984 Bowsky et al. ..... 174/152 GM
4,480,151 A * 10/1984 Dozier ..... 174/152 R
4,584,433 A * 4/1986 Bowsky et al. ..... 174/152 GM
5,391,061 A * 2/1995 Iizuka et al. ..... 174/152 GM
5,584,716 A * 12/1996 Bergman ..... 174/152 GM
6,107,566 A * 8/2000 Quadir et al. ..... 439/935
6,273,754 B1 * 8/2001 Bunch et al. ..... 439/935

FOREIGN PATENT DOCUMENTS

JP 7-22092 4/1995

* cited by examiner

*Primary Examiner*—Dean A. Reichard
*Assistant Examiner*—Adolfo Nino
(74) *Attorney, Agent, or Firm*—Wenderoth, Lind & Ponack, L.L.P.

(57) ABSTRACT

A motor-driven compressor is provided with a power supply terminal secured to a metallic housing and electrically connected to a power source. The power supply terminal includes a base secured to the metallic housing, a conductive element secured to the base, and an insulator for insulating the conductive element from the base. A portion of the conductive element and a portion of the insulator that are located inside the metallic housing are covered with an insulating resinous cover.

10 Claims, 4 Drawing Sheets

POWER SUPPLY TERMINAL FOR USE WITH A MOTOR-DRIVEN COMPRESSOR AND METHOD OF INSULATING SAME

BACKGROUND OF THE INVENTION

1. Field of the Invention

The present invention relates generally to a motor-driven compressor and, in particular but not exclusively, to the prevention of poor insulation between a power supply terminal and a metallic housing of the motor-driven compressor.

2. Description of the Related Art

FIG. 1 depicts a conventional motor-driven compressor 1. As shown therein, the motor-driven compressor 1 includes an electric motor 2 and a compression mechanism 4, both accommodated in a metallic shell or housing 6. When the compression mechanism 4 is driven by the electric motor 2, gas refrigerant drawn into the shell 6 through a suction pipe 6*a* is compressed and then discharged through a discharge pipe 6*b*. The electric motor 2 is supplied with electric power from outside via a power supply terminal 10 secured to an end face of the shell 6.

FIG. 2 depicts the structure of the power supply terminal 10. As shown therein, the power supply terminal 10 includes a metallic terminal base 14 secured to the shell 6 and a plurality of pins 11 secured to the terminal base 14 via a glass insulator 16 and a ceramic insulator 18 for electrical insulation. A tab 12, connected to the electric motor 2 via a lead wire 13, is secured to each of the pins 11.

A relatively high voltage is applied to the power supply terminal 10. By way of example, in applications where the electric motor 2 is supplied with electricity from a 100 V, 60 Hz power source, a voltage of about 60 V is applied to the power supply terminal 10. Further, an increased voltage is applied with an increase in frequency for driving the electric motor 2. On the other hand, the terminal base 14 is grounded via the shell 6. Accordingly, a large potential difference is created between the pins 11 and the terminal base 14 and, hence, high electrical resistance is required to maintain assured electrical insulation between the pins 11 and the terminal base 14. Particularly, in motor-driven compressors for use in electric cars or hybrid cars, high insulation resistance greater than 10 MΩ is generally required for enhanced safety.

However, the above-described conventional motor-driven compressor 1 entails a problem that the insulation resistance between the pins 11 and the terminal base 14 may become insufficient depending on the state of internal refrigerant. Although only gas refrigerant circulates within the motor-driven compressor 1 during normal operation, when the motor-driven compressor 1 is stopped, the gas refrigerant remaining therein is cooled, and there is a good chance that liquefied refrigerant is still left within the compressor. Because the liquefied refrigerant has a specific resistance smaller than the gas refrigerant, when the power supply terminal 10 is wet with or in some cases submerged under the liquid refrigerant, the insulation resistance between the pins 11 and the terminal base 14 is reduced to, for example, about 1 MΩ or less. When the motor-driven compressor 1 is operated under such conditions, it is likely that electric current supplied to the power supply terminal 10 leaks considerably to the metallic shell 6 through the terminal base 14. Particularly, in the case of the horizontal compressor shown in FIG. 1, in which the power supply terminal 10 is attached to an end face thereof, the power supply terminal 10 is apt to become wet with liquefied refrigerant stored therein and, hence, there is a good chance that poor insulation occurs between the pins 11 and the terminal base 14.

SUMMARY OF THE INVENTION

The present invention has been developed to overcome the above-described disadvantages.

It is accordingly an objective of the present invention to provide a power supply terminal that is suited for use with a motor-driven compressor and can prevent poor insulation between it and a metallic housing of the motor-driven compressor.

Another objective of the present invention is to provide a method of insulating the power supply terminal from the metallic housing of the motor-driven compressor.

In accomplishing the above and other objectives, the power supply terminal includes a base secured to the metallic housing, a conductive element secured to the base, an insulator for insulating the conductive element from the base, and an insulating resinous cover for covering a portion of the conductive element and a portion of the insulator that are located inside the metallic housing.

This construction elongates the shortest distance between the conductive element and the base or reduces the cross section of a current leakage path, making it possible to prevent poor insulation between the power supply terminal and the metallic housing.

It is preferred that the insulating resinous cover is in the form of a tube having an inner diameter for allowing the conductive element and the insulator to be inserted thereinto. The use of the tube-shaped insulating resinous cover facilitates the covering work for the power supply terminal and maintenance work such as replacement work of a lead wire.

Advantageously, the insulating resinous cover is made of a heat-shrinkable material such, for example, as a fluorine-based resin. The heat-shrinkable cover can be readily held in close contact with the insulator when heated, thus enhancing the insulation resistance between the conductive element and the base. The cover made of a fluorine-based resin has good durability with respect to both refrigerant and oil, enhancing the reliability of the compressor.

The motor-driven compressor may be a horizontal one having an end face to which the power supply terminal is secured. In the case of the horizontal compressor, although the power supply terminal is occasionally submerged in liquid refrigerant, the insulating resinous cover acts to prevent poor insulation.

In another aspect of the present invention, a method of insulating a power supply terminal from a metallic housing of a motor-driven compressor includes the steps of: (a) moving a heat-shrinkable resinous tube towards the power supply terminal so that a portion of the conductive element and a portion of the insulator that are located inside the metallic housing are covered with the heat-shrinkable resinous tube, (b) inserting a conductive element connector into an opening of the heat-shrinkable resinous tube and connecting the conductive element connector to the conductive element, and (c) heating the heat-shrinkable resinous tube to shrink the heat-shrinkable resinous tube.

According to this method, a portion of the power supply terminal that is located inside the metallic housing can be easily covered with the resinous tube without performing new processing with respect to the parts that have been hitherto used.

Conveniently, before the step (b), a notch is formed in the heat-shrinkable resinous tube so that a lead wire, which is connected to the conductive element connector so as to extend therefrom in a direction perpendicular thereto, is inserted into the notch during the step (b). The provision of such a notch facilitates the connection of the L-shaped conductive element connector to the conductive element.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

This application is based on an application No. 11-364418 filed Dec. 22, 1999 in Japan, the content of which is herein expressly incorporated by reference in its entirety.

Figure 1:
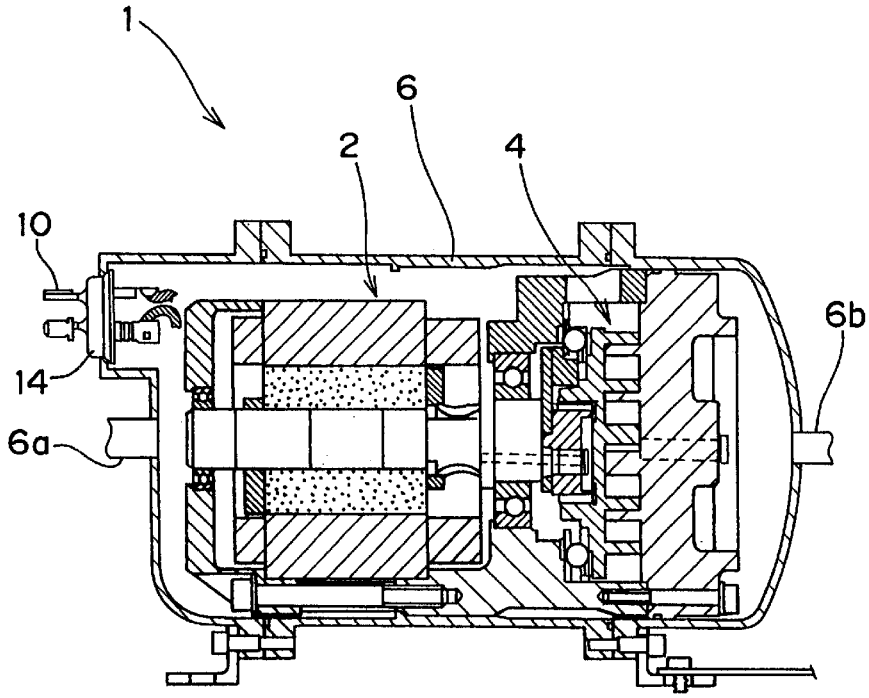
Fig. 1 PRIOR ART
FIG. 1 is a cross-sectional view of a conventional motor-driven horizontal compressor.
Figure 2:
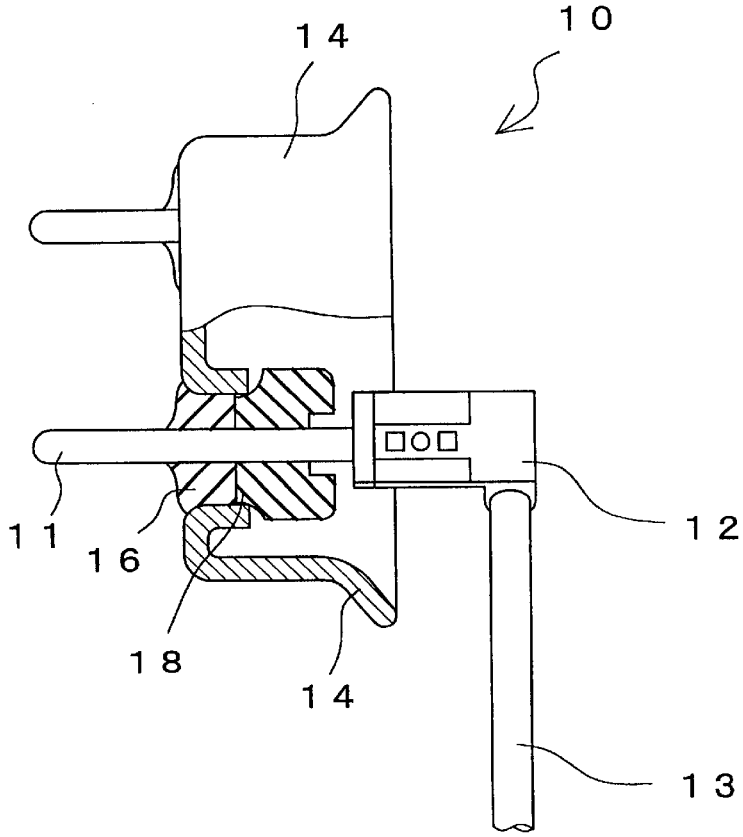
Fig. 2 PRIOR ART
FIG. 2 is a side view, partly in section, of a power supply terminal secured to the conventional motor-driven compressor of FIG. 1.

Referring now to the drawings, there is shown in FIG. 3*a* power supply terminal 10 embodying the present invention, which is applied to a motor-driven compressor. The motor-driven compressor to which the present invention is applied may be that shown in FIG. 1 and includes a compression mechanism and an electric motor for driving the compression mechanism, both accommodated in a metallic shell or housing. The electric motor is supplied with electricity from outside via the power supply terminal 10.

Figure 3:
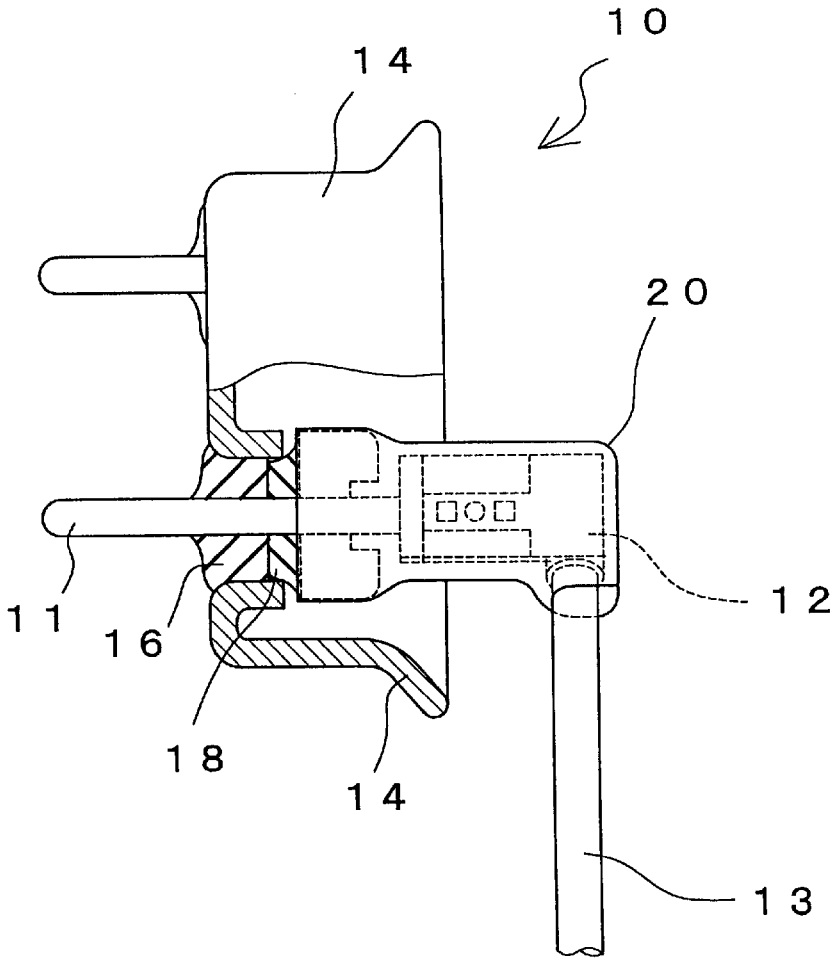
FIG. 3 is a side view, partly in section, of a power supply terminal according to the present invention.

As shown in FIG. 3, the power supply terminal 10 includes a metallic terminal base 14 secured to the shell of the compressor and a plurality of pins 11 each secured to the terminal base 14 via a glass insulator 16 and a ceramic insulator 18 for electrical insulation. A tab 12 is secured to each of the pins 11, and the electric motor is connected thereto via a lead wire 13. The power supply terminal 10 according to the present invention further includes insulating resinous covers 20 for covering the respective tabs 12, ceramic insulators 18 and the like, which are located inside the shell. The reason for covering a portion of the power supply terminal 10 including the ceramic insulators 18 is to increase the insulation resistance between the pins 11 or tabs 12 and the terminal base 14 by elongating the shortest distance along which leakage current flows or reducing the cross section across which the leakage current flows. It is sufficient if the power supply terminal 10 is partially covered with the insulating resinous covers 20 so that the shortest distance between the conductive elements may be elongated or the cross section of a current leakage path may be reduced. To this end, the glass insulators 16 may also be covered with the respective covers 20.

In order to cover the power supply terminal 10 using an insulating resin, there are various ways of covering such, for example, as winding a resinous tape around the portions to be covered or molding them with a resinous material. It is, however, preferred that tube-shaped or cylindrical insulating resinous covers 20 be used. In the case of such insulating resinous covers 20, it is sufficient if each of them is first positioned with respect to the power supply terminal 10 and then moved or pushed towards the portion to be covered so that an end portion thereof may be held in close contact with the associated ceramic insulator 18. The use of the cylindrical insulating resinous covers 20 facilitates the covering work for the power supply terminal 10 and maintenance work such as replacement work of the lead wires 13. Even if the cylindrical insulating resinous covers 20 are used, a gap is created between them and the tabs 12, because the tabs 12 are not generally formed into a cylindrical shape. However, if the insulating resinous covers 10 are positioned as close to the associated ceramic insulators 18 as possible so that the current leakage path may be reduce, poor insulation can be effectively prevented.

Figure 4A:
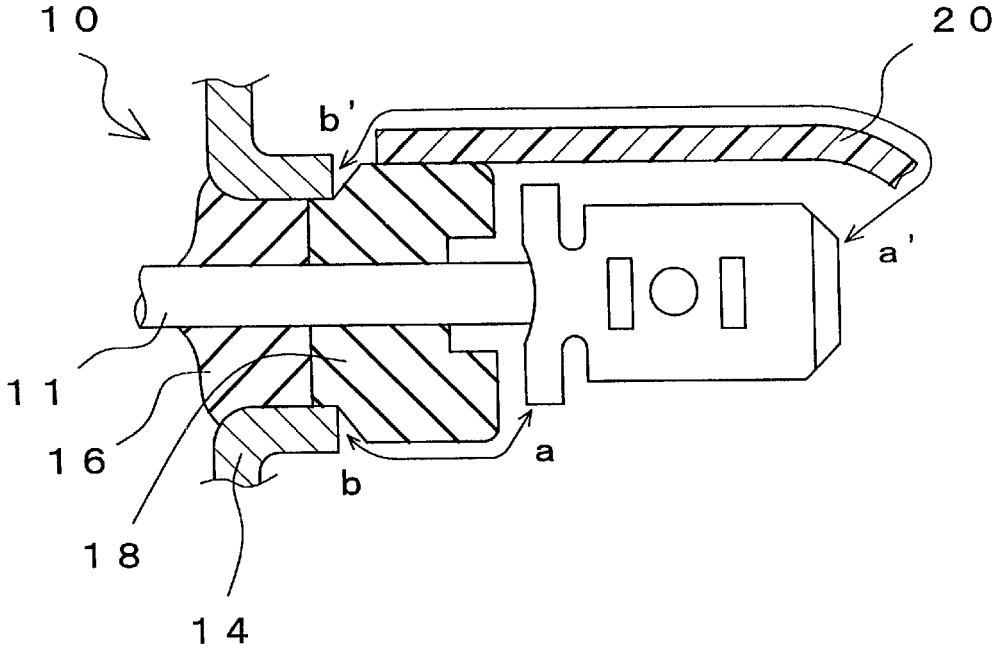
FIG. 4A is a cross-sectional view of an essential portion of the power supply terminal, particularly indicating the shortest distance between two conductors in the power supply terminal according to the present invention and in the conventional one.
Figure 4B:
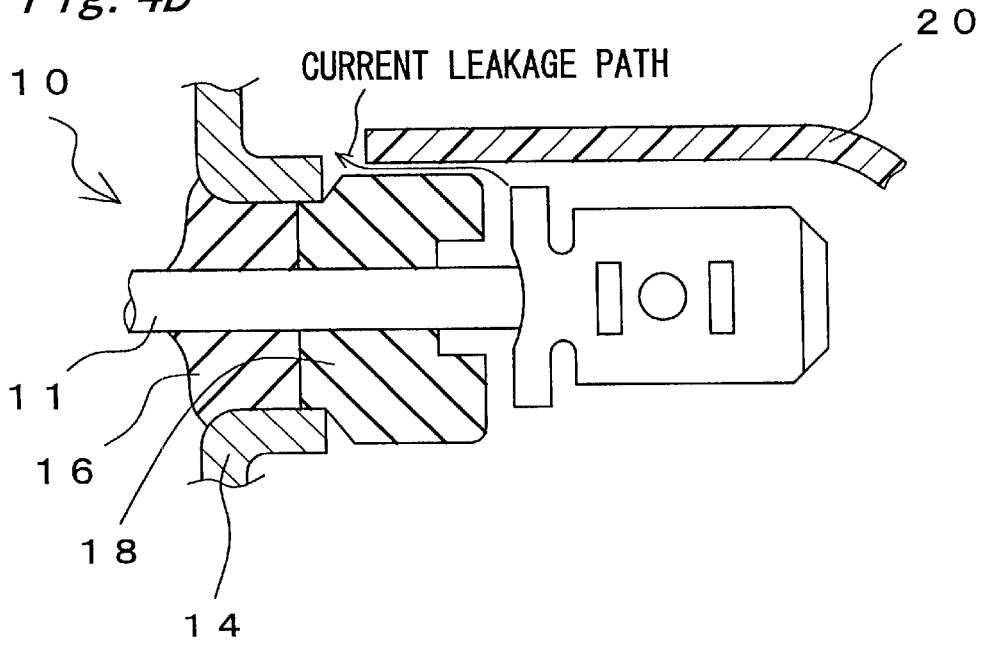
FIG. 4B is a view similar to FIG. 4A, but particularly indicating a current leakage path.

The improvement in insulation resistance by the use of the cylindrical insulating resinous covers 20 is explained hereinafter with reference to FIGS. 4A and 4B.

The leakage current flows between the pins 11 or tabs 12 and the terminal base 14 via refrigerant existing therebetween and having a small specific resistance. For this reason, the magnitude of the insulation resistance between the tabs 12 and the terminal base 14 depends on the shortest length along the surface of an insulating material or materials for insulating them and the cross section of the current leakage path. Without any insulating resin, the aforementioned shortest length is the distance along an arrow between a point (a) on the tab 12 and a point (b) on the terminal base 14 in FIG. 4A, and the cross section of the current leakage path is extremely large. On the other hand, in the case where the insulating resinous cover 20 is held in close contact with the ceramic insulator 18, the shortest length is the distance along an arrow between a point (a') on the tab 12 and a point (b') on the terminal base 14 in FIG. 4A. Accordingly, the shortest length between the tab 12 and the terminal base 14 can be elongated by covering the tab 12 and the ceramic insulator 18 with the insulating resinous cover 20, making it possible to increase the. insulation resistance. If the insulating resinous cover 20 is not held in close contact with the ceramic insulator 18, as shown in FIG. 4B, the shortest length is the same as that in the conventional power supply terminal. However, the cross section of the current leakage path is limited to an area between the cylindrical insulating resinous cover 20 and the ceramic insulator 18, thus increasing the insulation resistance.

It is preferred that the insulating resinous cover 20 be made of heat-shrinkable material. The use of the heat-shrinkable material enhances the degree of adhesion of the insulating resinous cover 20 to the ceramic insulator 18 by heat-shrinking the insulating resinous cover 20 after having covered it on the tab 12 and the ceramic insulator 18.

Although various resins including rubber-based ones, plastic-based ones and the like that have insulating properties to block the leakage current can be used for the insulating resinous cover 20, the use of fluorine-based resins is particularly preferred in view of the durability with respect to both refrigerant and oil.

Figure 5A:
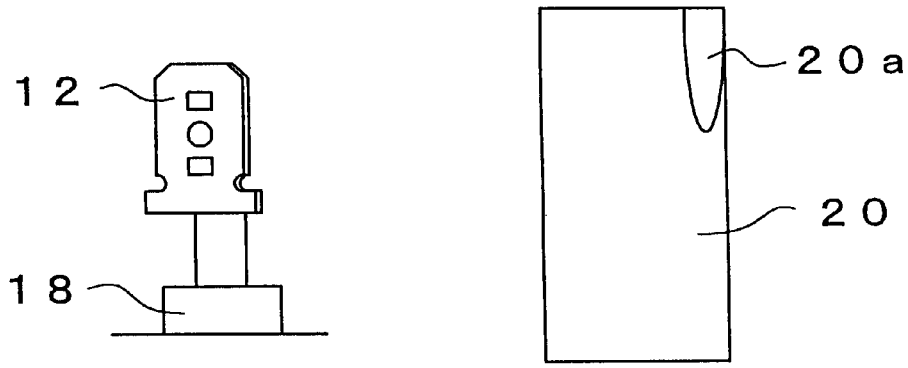
FIG. 5A is a front view of an insulating resinous cover and a conductive element of the power supply terminal that is to be covered with the insulating resinous cover.
Figure 5B:
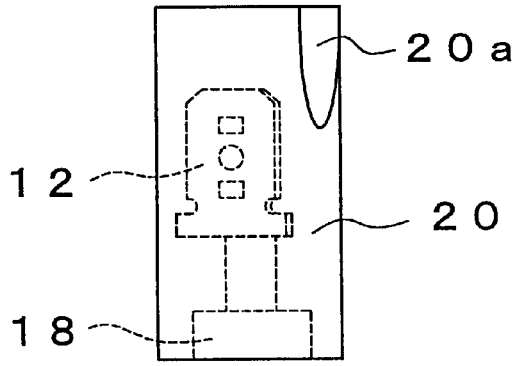
FIG. 5B is a front view of the insulating resinous cover in which the conductive element has been inserted.
Figure 5C:
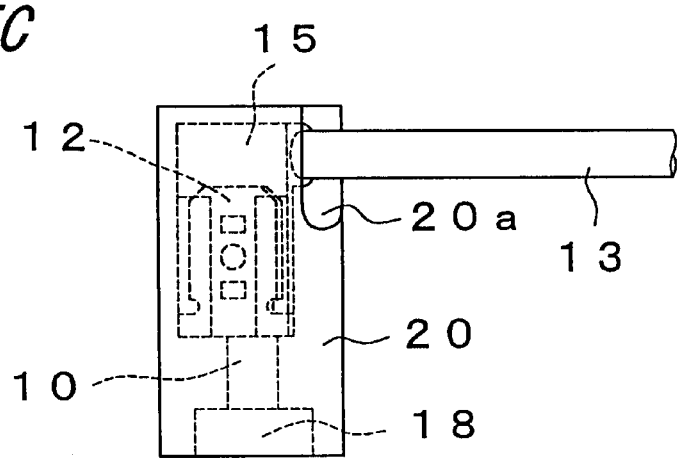
FIG. 5C is a front view of the insulating resinous cover after the connector with a lead wire has been connected to the conductive element.

FIGS. 5A to 5C depict a method of covering a portion of the power supply terminal 10, i.e., the tab 12, the terminal base 18 and the like, when the heat-shrinkable material is used for the insulating resinous cover 20.

As shown in FIG. 5A, a heat-shrinkable resinous tube 20 is first prepared. The heat-shrinkable tube 20 has an inner diameter into which at least the tab 12 can be inserted and also has an overall length greater than the length of the portion of the power supply terminal 10 which is located inside the metallic shell.

As shown in FIG. 5B, after aligning the heat-shrinkable tube 20 with the tab 12, the heat-shrinkable tube 20 is pushed or moved towards the tab 12 so that an upper portion of the ceramic insulator 18 as well as the tab 12 may be covered with the heat-shrinkable tube 20.

Thereafter, as shown in FIG. 3C, a tab receptacle (tab connector) 15 to which the lead wire 13 is connected is inserted into an opening of the heat-shrinkable tube 20 and connected to the tab 12. The heat-shrinkable tube 20 is then caused to shrink by heating it, thereby bringing it into close contact with the tab 12 and the ceramic insulator 18.

According to the above-described method, the tab 12, ceramic insulator 18 and the like can be easily covered with the insulating resinous cover (heat-shrinkable tube) 20 without performing new processing with respect to the parts that have been hitherto used. Furthermore, because the degree of adhesion of the cover 20 to the tab 12 and the ceramic insulator 18 can be easily increased, the insulation resistance can be effectively enhanced.

In the case where the lead wire 13 extends from the tab receptacle 15 in a direction perpendicular thereto, it is preferred that a notch 20*a* be formed in an end portion of the tube 20 in advance. By so doing, when the tab receptacle 15 is connected to the tab 12, the lead wire 13 is inserted into the notch 20*a* of the tube 20 without impinging on the edge of the tube 20, as shown in FIG. 5C. Although the tube 20 may be an L-shaped one so as to match the configuration in which the lead wire 13 is connected to the tab receptacle 15, a difficulty will be encountered in inserting the tab receptacle 15 into the tube 20.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A power supply terminal for use with a motor-driven compressor having a metallic housing in which a compression mechanism and an electric motor for driving the compression mechanism are accommodated, said power supply terminal comprising:

a base to be secured to the metallic housing;

a conductive element secured to said base;

a conductive element connector secured to said conductive element for connection with the electric motor;

an insulator for insulating said conductive element from said base; and an insulating resinous cover for covering said conductive element connector, a portion of said conductive element and a portion of said insulator that are arranged to be located inside the metallic housing.

2. The power supply terminal according to claim 1, wherein said insulating resinous cover comprises an insulating resinous tube having an inner diameter for allowing said conductive element, said insulator and said conductive element connector to be inserted thereinto.

3. The power supply terminal according to claim 2, wherein said insulating resinous tube is formed of a heat-shrinkable material.

4. The power supply terminal according to claim 2, wherein said conductive element connector is secured to an end of said conductive element arranged to be disposed inside the metallic housing.

5. The power supply terminal according to claim 1, wherein said insulating resinous cover is made of a fluorine-based resin.

6. A motor-driven compressor having the power supply terminal according to claim 1, wherein said motor-driven compressor comprises a horizontal motor-driven compressor having an end face to which said power supply terminal is secured.

7. The power supply terminal according to claim 1, wherein said conductive element connector is secured to an end of said conductive element arranged to be disposed inside the metallic housing.

8. A method of insulating a power supply terminal from a metallic housing of a motor-driven compressor, said power supply terminal comprising a base to be secured to the metallic housing, a conductive element secured to the base, and an insulator for insulating the conductive element from the base, said method comprising:

(a) moving a heat-shrinkable resinous tube towards the power supply terminal so that a portion of the conductive element and a portion of the insulator that are located inside the metallic housing are covered with the heat-shrinkable resinous tube;

(b) inserting a conductive element connector into an opening of the heat-shrinkable resinous tube and connecting the conductive element connector to the conductive element; and (c) heating the heat-shrinkable resinous tube to shrink the heat-shrinkable resinous tube.

9. The method according to claim 8, further comprising, before said inserting and connecting of said conductive element connector, forming a notch in the heat-shrinkable resinous tube so that a lead wire, which is connected to the conductive element connector so as to extend therefrom in a direction perpendicular thereto, is inserted into the notch during said inserting and connecting of said conductive element connector.

10. The method according to claim 8, wherein said resinous tube has first and second open ends opposite each other;

in moving said resinous tube towards the power supply terminal, said first open end is inserted over a portion of said conductive element and a portion of said insulator; and said inserting of said conductive element connector into said opening of the resinous tube comprises inserting said conductive element connector into said second open end of said resinous tube.

* * * * *